United States Patent [19]

McDermott

[11] 4,035,113

[45] July 12, 1977

[54] GEROTOR DEVICE WITH LUBRICANT SYSTEM

[75] Inventor: Hugh L. McDermott, Minneapolis, Minn.

[73] Assignee: Eaton Corporation, Cleveland, Ohio

[21] Appl. No.: 654,141

[22] Filed: Jan. 30, 1976

[51] Int. Cl.[2] ..... F03C 3/00; F04C 15/00; F16D 3/18; F01M 1/00

[52] U.S. Cl. ..... 418/61 B; 418/102; 64/9 R; 184/6

[58] Field of Search ..... 418/61 B, 94, 102; 184/6; 64/9 R, 23

[56] References Cited

U.S. PATENT DOCUMENTS

| | | | |
|---|---|---|---|
| 3,452,543 | 7/1969 | Goff et al. | 418/61 B |
| 3,782,866 | 1/1974 | McDermott | 418/61 B |
| 3,863,449 | 2/1975 | White, Jr. | 418/61 B |

FOREIGN PATENT DOCUMENTS

| | | | |
|---|---|---|---|
| 1,628,127 | 8/1971 | Germany | 418/61 B |

*Primary Examiner*—John J. Vrablik
*Attorney, Agent, or Firm*—Teagno & Toddy

[57] ABSTRACT

A rotary fluid pressure device of the type including agerotor gear set having an externally-toothed rotor orbiting and rotating within an internally-toothed stator. An intermediate shaft has one end in splined engagement with the rotor and the other end defining a large set of internal splines. The device includes an output shaft assembly, also defining a large set of internal splines. A large dogbone shaft having external splines at each end transmits torque between the intermediate shaft and the output shaft assembly. The intermediate shaft has an axial bore which communicates pressurized lubricant to the one end of the dogbone shaft, a portion of the pressurized lubricant flowing radially outward over the end of the dogbone and through the spline connection between the dogbone and the intermediate shaft. Another portion of the pressurized lubricant flows through an axial lubricant passage in the dogbone to the opposite end of the dogbone, from where it flows radially over that end of the dogbone and through the spline connection between the dogbone and the output shaft assembly. These portions of lubricant then recombine and enter a return lubricant path.

9 Claims, 3 Drawing Figures

GEROTOR DEVICE WITH LUBRICANT SYSTEM

BACKGROUND OF THE DISCLOSURE

The present invention relates to rotary fluid pressure devices, and more particularly, to an improved lubricant system for use therein.

The present invention is particularly applicable to rotary fluid pressure devices of the gerotor type, and will be described in connection therewith. However, it should be appreciated that the invention may have broader application and may be utilized in any rotary fluid pressure device wherein torque is transmitted from one internally splined member to another such as by means of an externally splined dogbone shaft where it is desirable to maintain a constant flow of lubricant through both spline connections.

The invention is especially suited for use with hydraulic gerotor motors, a typical example of which is shown in U.S. Pat. No. 3,572,983, assigned to the assignee of the present invention. Because of the relatively low torques being transmitted from the rotor to the output shaft by the main drive shaft in such motors, lubrication of the spline connections at either end of the main drive shaft usually did not present a serious problem. However, proper lubrication of these spline connections became more important as the size and torque capability of gerotor motors increased. More recently, the torque output capability of gerotor motors was greatly increased by the development illustrated in U.S. Pat. No. 3,782,866, also assigned to the assignee of the present invention. The basis for this development was the realization that the primary factor limiting the torque output capability of the motor was the strength of the spline connection between the rotor and the main shaft and between the main shaft and the output shaft. Thus, it is now well-known in the art to provide a high torque gerotor motor utilizing an intermediate shaft, one end of which is connected to the rotor of the gerotor by a set of straight splines and the other end of which defines the relatively large set of internal splines. At the same time, the output shaft also defines a relatively large set of internal splines and a large dogbone shaft, having external splines at either end thereof, provides the main drive connection between the intermediate shaft and the output shaft. With the increased size and strength of these spline connections, the greater amount of torque being transmitted resulted in the generation of more frictional heat, as well as the creation of more wear particles. Initially, lubrication of the spline connections in hgh torque motors such as those illustrated in the referenced patent was accomplished merely by providing a lubricant sump that the external splines on the main shaft would pass through as the shaft orbited and rotated. However, this means of lubrication has not proven consistently satisfactory.

SUMMARY OF THE INVENTION

It is an object of the present invention to provide a rotary fluid pressure device having an improved lubricant system for large spline connections in high torque gerotor motors.

It is a more specific object of the present invention to provide such a lubricant system which utilizes a constant flow of lubricant to transfer frictional heat more effectively and to transport wear particles away from the spline connections.

It is another object of the present invention to provide a lubricant system for a rotary fluid pressure device which accomplishes the above-stated objects and which divides the lubricant flow into two separate portions, each of the portions lubricating one of the spline connections.

The above and other objects of the present invention are accomplished by the provision of an improved rotary fluid pressure device and lubrication system therefor, which includes a casing, a gerotor gear set, and an orbiting means associated with the gerotor gear set. The orbiting means defines first internal splines having both orbital and rotational movement. An output shaft assembly is rotatably associated with the casing and defines second internal splines, and a connecting shaft member includes first external splines in engagement with said first internal splines and second external splines in engagement with said second internal splines to transmit torque between the orbiting means and the output shaft assembly. The connecting shaft member has first and second ends and defines an axially-oriented lubricant passage having first and second end portions disposed adjacent the first and second external splines, respectively. The fluid pressure device includes means defining a lubricant path disposed to communicate pressurized lubricant to one of the first and second ends of the connecting shaft member. One portion of the pressurized lubricant flows over the one end and into the adjacent external splines, while another portion of the pressurized lubricant flows through the lubricant passage and over the other end of the connecting shaft member and into the adjacent external splines. Preferably, the fluid pressure device includes means defining a return lubricant path and the two portions of pressurized lubricant flow from the first and second external splines into the return lubricant path.

DESCRIPTION OF THE PREFERRED EMBODIMENT

Figure 1:
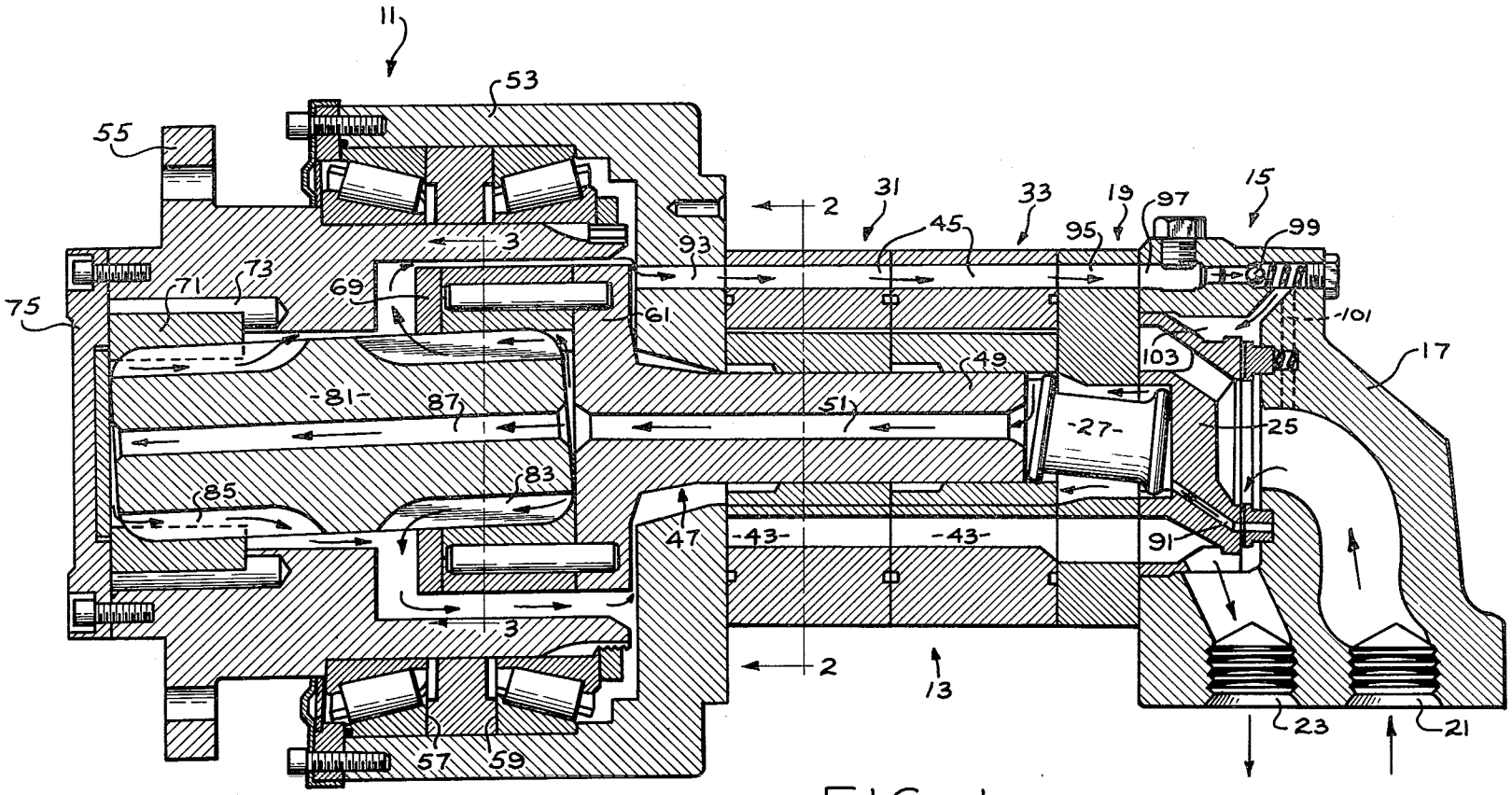
FIG. 1 is an axial cross section of a gerotor motor made in accordance with the teachings of the present invention.

Referring now to the drawings, which are not intended to limit the present invention, FIG. 1 illustrates an hydraulic motor including an output section, generally designated 11, a gerotor section, generally designated 13, and a valve section, generally designated 15. The valve section 15 may be of the type well-known in the art, such as is illustrated in U.S. Pat. No. 3,572,983, which is incorporated herein by reference. The referenced patent also describes and illustrates the operative association of the valve section 15 with the gerotor section 13. The configuration of the output section 11, as well as its operative association with the gerotor section 13, is described and illustrated in U.S. Pat. No. 3,782,866, which is also incorporated herein by reference. Thus, the details and operation of sections 11, 13 and 15, will be described only briefly.

The valve section 15 includes a body portion 17 and a port plate 19. The body portion 17 defines an inlet port 21 and an outlet port 23 (see flow arrows), and a disc valve member 25 is rotatably disposed within the body portion 17. A valve drive shaft 27 transmits an orbital and rotational movement of the gerotor section 13 to the disc valve member 25, and a valve balancing ring 29 is seated within the body portion 17 and against the disc valve member 25.

Figure 2:
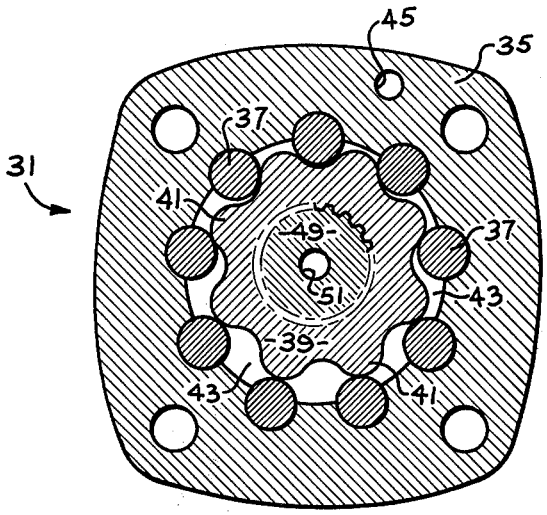
FIG. 2 is a transverse cross section taken on line 2—2 of FIG. 1.

In the subject embodiment, the hydraulic motor is a high torque output motor and thus, the gerotor section 13 comprises a pair of substantially identical gerotor gear sets 31 and 33, each of which, as may best be seen in FIG. 2, includes a stator member 35 having a plurality of generally semi-cylindrical pockets receiving rollers 37, serving as the internal teeth of the stator 35. Each gerotor gear set also includes a rotor 39 having a plurality of external teeth 41, the number of teeth 41 being one less than the number of rollers 37, such that the external teeth 41 and rollers 37 interengage to define a plurality of expanding and contracting volume chambers 43 as is well-known in the art. The stator member 35 defines a bore 45 extending axially therethrough, the function of which will be described subsequently.

An intermediate shaft assembly 47 includes a shaft portion 49 in splined engagement with each of the rotors 39, such that the gerotor gear sets 31 and 33 will, at any instant, have all of their component parts in the same relative position. The shaft portion 49 defines a generally axial bore 51, the function of which will also be described subsequently.

Figure 3:
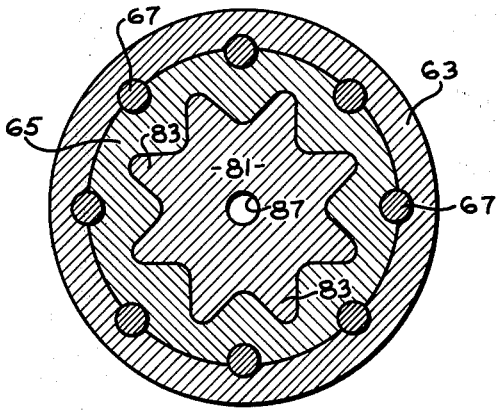
FIG. 3 is a transverse cross section taken on line 3—3 of FIG. 1.

The output section member includes a casing 53 within which an annular output member 55 is mounted for rotation, such as by means of a pair of tapered roller bearing sets 57 and 59. The intermediate shaft assembly 47 includes a flange portion 61 to which is attached by any suitable means a sleeve member 11 (see FIG. 3). Disposed within the sleeve member 63 is an internally-splined member 65, with relative rotation between the sleeve member 63 and internally splined member 65 being prevented by means of a plurality of torque pins 67. Relative axial movement between the sleeve member 63, spline member 65, and torque pins 67 is prevented by a retainer plate 69, attached at the forward end of the intermediate shaft assembly 47. Disposed within the output member 55, and at the forward end thereof, is an internally splined member 71, which may be similar, or even identical to the internally splined member 65. The splined member 71 may be positioned non-rotatably relative to the output member 55 by means of a plurality of torque pins 73, with axial retention of the spline members 71 and pins 73 being achieved by means of a cover 75, bolted to the output member 55.

Disposed within the output member 55 is a dogbone shaft 81, having a set of external splines 83 in splined engagement with the internally-splined member 65 and set of external splines 85 in splined engagement with the internally splined member 71, to transmit the orbital and rotational movement of the intermediate shaft assembly 47 into pure rotational movement of the output member 55. The dogbone shaft 81 further defines an axial passage 87, the function of which will be described subsequently.

It should be appreciated that although the present invention is being described in connection with a high torque motor, it may be utilized with various other types of fluid pressure devices, such as a pump, in which case the output section 11 would actually be the input. Therefore, it should be understood that, as used herein, such terms as "output shaft" are not intended to limit the present invention, and the use of such terms is intended to mean and include input shafts, as in the case of a pump, as well as elements such as output member 55 which are not actually in the form of a conventional shaft.

Referring now to the valve section 15 of FIG. 1, the disc valve member 25 defines an angled passageway 91, such that a thin film of the pressurized fluid entering the motor through inlet port 21 is able to pass between the valve balancing ring 29 and the face of the disc valve member 25 and enter the passageway 91 as is well-known in the art. Typically, the fluid pressure at the inlet port 21 and in the expanding volume chambers of the gerotor section 13 may be about 3,000 psi, while the fluid pressure in the contracting volume chambers (assuming use as a motor) and the outlet port 23 may be about 100 psi. With such fluid pressures present, the fluid pressure in the passageway 91 and in the remainder of the lubrication circuit to be described is generally about 5 or 10 psi above return fluid pressure (i.e., about 105 to 110 psi).

From the passageway 91, the lubrication fluid flows over the spline connection between the valve drive shaft 27 and the disc valve member 25, then flows axially to the left in FIG. 1 where it lubricates the spline connection between the valve drive shaft 27 and the rotor 39 of gerotor gear set 33.

The lubricant next enters the axial bore 51 and continues flowing to the left in FIG. 1 until it passes from the bore 51 and becomes available to lubricate the dogbone shaft 81. At this point, the total lubricant flow divides into two portions which, preferably, each comprise about one-half of the total lubricant flow reaching this point. One portion of the lubricant flows radially outward over the right-hand end surface of the dogbone shaft 81. This portion of the lubricant then flows through the connection between the external splines 83 and the internally splined member 65, with the flow of lubricant being more effective than a sump for purposes of dissipating frictional heat and carrying away metal wear particles breaking loose at the spline connection.

The other portion of the lubricant flow enters the axial passage 87 and flows to the left until it leaves the passage 87 and flows radially outward over the left-hand end surface of the dogbone shaft 81. This lubricant then flows toward the right in FIG. 1 through the connection between the external splines 85 and the internally splined members 71. As the two portions of the lubricant flow out of their respective spline connections, they re-combine as shown by the flow arrows and enter what may be considered a return lubricant path defined by the inner surface of the output member 55 and the outer surface of the intermediate shaft assembly 47. The return lubricant then enters an axial bore 93 in the casing 55, the bore 93 being in alignment with each of the bores 45 in the gerotor gear sets 31 and 33, then flows into an aligned bore 95 in the port plate 19 and finally, through a bore 97 in the body portion 17. The return lubricant in bore 97 unseats a ball check valve 99, enters an angled passage 101, and flows into annular chamber 103 defined by the disc valve member 25 and the body portion 17. Annular chamber 103 also contains the return flow from the contracting volume chambers, and from annular chamber 103, the return fluid flows through outlet port 23 to the reservoir.

Thus, it will be apparent that the lubricant system of the present invention provides an improved arrangement for lubricating large, high-torque spline connections at opposite ends of a dogbone shaft by dividing the lubricant flow into two separate portions, with one portion flowing through one of the spline connections and the other passing axially through the dogbone shaft and then through the opposite spline connection. Although the invention has been described in connection with a preferred embodiment, it will be apparent to those skilled in the art that various modifications and alterations may be made within the scope of the present invention, and it is my intention to include all such modifications and alterations insofar as they come within the scope of the appended claims.

I claim:

1. A rotary fluid pressure device comprising:

a. a casing;

b. a gerotor gear set operatively associated with said casing;

c. orbiting means associated with said gerotor gear set and defining first internal splines having both orbital and rotational movement;

d. a shaft assembly rotatably associated with said casing and defining second internal splines;

e. a connecting shaft member including first external splines in engagement with said first internal splines and second external splines in engagement with said second internal splines to transmit torque between said orbiting means and said shaft assembly;

f. said connecting shaft member having first and second ends and defining an axially oriented lubricant passage having first and second end portions disposed at the axial ends of said connecting shaft member adjacent said first and second external splines, respectively; said lubricant passage being in fluid communication only between said axial ends g. said fluid pressure device including means defining a lubricant path disposed to communicate pressurized lubricant to said connecting shaft member, one portion of said pressurized lubricant flowing through a lubricant path including one of said first and second ends of said shaft member and said one of said first and second external splines, and another portion of said pressurized lubricant flowing through a lubricant path including the other of said first and second external splines, the other of said first and second ends of said connecting shaft member and said lubricant passage;

h. said fluid pressure device including means defining a return lubricant path, said first lubricant path and said second lubricant path flowing into said return lubricant path.

2. A rotary fluid pressure device comprising:

a. a casing;

b. a gerotor gear set operatively associated with said casing;

c. orbiting means associated with said gerotor gear set and defining first internal splines having both orbital and rotational movement;

d. a shaft assembly rotatably associated with said casing and defining second internal splines;

e. a connecting shaft member including first external splines in engagement with said first internal splines and second external splines in engagement with said second internal splines to transmit torque between said orbiting means and said shaft assembly;

f. said connecting shaft member having first and second ends and defining an axially-oriented lubricant passage having first and second end portions disposed adjacent said first and second external splines, respectively, said lubricant passage being in fluid communication only between said first and second end portions;

g. said fluid pressure device including means defining a lubricant path disposed to communicate pressurized lubricant to one of said first and second ends of said connecting shaft member, one portion of said pressurized lubricant flowing over said one end and into said one of said first and second external splines and another portion of said pressurized lubricant flowing through said lubricant passage, over the other of said first and second ends of said connecting shaft member, and into said other of said first and second external splines;

h. said fluid pressure device including means defining a return lubricant path, said one portion and said another portion of said pressurized lubricant flowing from said one and said other of said first and second external splines, respectively, into said return lubricant path.

3. A rotary fluid pressure device as claimed in claim 2 wherein the axis of said lubricant passage is approximately coincidental with the axis of rotation of said shaft member.

4. A rotary fluid pressure device as claimed in claim 2 wherein said gerotor gear set includes an externally toothed rotor and said orbiting means comprises an intermediate shaft assembly having one end in engagement with said rotor and the other end defining said first internal splines.

5. A rotary fluid pressure device as claimed in claim 4 wherein said intermediate shaft assembly defines a generally axial bore, said lubricant path including said bore.

6. A rotary fluid pressure device, comprising:

a. a casing;

b. a gerotor gear set including an internally toothed member fixed relative to said casing and an externally toothed member eccentrically disposed within said internally-toothed member for orbital and rotational movement therein;

c. an intermediate shaft assembly having one end fixed relative to said externally toothed member and the opposite end defining first internal splines;

d. an output shaft assembly rotatably disposed relative to said casing and defining second internal splines;

e. a shaft member including first external splines in engagement with said first internal splines and second external splines in engagement with said second internal splines to transmit torque between said intermediate shaft assembly and said output shaft assembly;

f. said shaft member having first and second ends disposed adjacent said first and second external splines, respectively, and defining a generally axially oriented lubricant passage having first and second ends; and g. said fluid pressure device including means defining a lubricant path disposed to communicate pressurized lubricant to said first end of said shaft member; a portion of said lubricant path being defined by said intermediate shaft assembly; one portion of said pressurized lubricant flowing over said first end of said shaft member and through said first external splines; another portion of said pressurized lubricant flowing through said lubricant passage, over said second end of said shaft member and through said second external splines.

7. A rotary fluid pressure device as claimed in claim 6 wherein said one portion of said pressurized lubricant comprises approximately one-half of said pressurized lubricant and said other portion comprises approximately one-half of said pressurized lubricant.

8. A high-torque fluid motor comprising:

a. a casing;

b. a gerotor gear set including an internally toothed member fixed relative to said casing and an externally toothed member eccentrically disposed within said internally toothed member for orbital and rotational movement therein, said externally toothed member defining a set of internal splines;

c. an intermediate shaft assembly having one end in engagement with said internal splines of said externally toothed member and the opposite end defining first internal splines, said first internal splines being relatively larger than said set of internal splines defined by said externally toothed member;

d. an output shaft assembly rotatably disposed relative to said casing and defining second internal splines;

e. a shaft member including first external splines in engagement with said first internal splines and second external splines in engagement with said second internal splines to transmit torque between said intermediate shaft assembly and said output shaft assembly;

f. said shaft member having first and second ends disposed adjacent said first and second external splines, respectively, and defining a generally axially oriented lubricant passage having first and second ends;

g. said fluid pressure device including means providing pressurized lubricant to said first end of said shaft member, one portion of said pressurized lubricant flowing over said first end of said shaft member and through said first external splines, another portion of said pressurized lubricant flowing through said lubricant passage, over said second end of said shaft member and through said second external splines; and h. said fluid motor including means defining a return lubricant path, said one portion and said another portion of said pressurized lubricant flowing from said first and second external splines, respectively, into said return lubricant path.

9. A high-torque fluid motor as claimed in claim 8 wherein said intermediate shaft assembly defines a lubricant passage and said means providing said pressurized lubricant includes said lubricant passage.

* * * * *

UNITED STATES PATENT AND TRADEMARK OFFICE

CERTIFICATE OF CORRECTION

PATENT NO. : 4,035,113

DATED : July 12, 1977

INVENTOR(S) : Hugh L. McDermott

It is certified that error appears in the above-identified patent and that said Letters Patent are hereby corrected as shown below:

Col. 1, line 52: "hgh" should read "high".

Col. 3, line 34: "11" should read "63".

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*